US006004708A

United States Patent [19]

Bellino et al.

[11] Patent Number: 6,004,708

[45] Date of Patent: Dec. 21, 1999

[54] ELECTROPHOTOGRAPHIC PHOTOCONDUCTOR CONTAINING FLUORENYL-AZINE DERIVATIVES AS CHARGE TRANSPORT ADDITIVES

[75] Inventors: Mark Thomas Bellino, Longmont; Robert Bruce Champ; Weimei Luo, both of Boulder, all of Colo.

[73] Assignee: Lexmark International, Inc., Lexington, Ky.

[21] Appl. No.: 09/292,531

[22] Filed: Apr. 15, 1999

[51] Int. Cl.[6] ..... G03G 5/047

[52] U.S. Cl. ..... 430/58.45; 430/58.4; 430/83

[58] Field of Search ..... 430/58.4, 58.45, 430/83

[56] References Cited

U.S. PATENT DOCUMENTS

| | | | |
|---|---|---|---|
| 4,278,747 | 7/1981 | Murayama et al. | 430/58.45 |
| 4,362,798 | 12/1982 | Anderson et al. | 430/83 |
| 4,415,640 | 11/1983 | Goto et al. | 430/58.45 |

FOREIGN PATENT DOCUMENTS

| | | |
|---|---|---|
| 3716982 | 11/1987 | Germany . |
| 57-138644 | 8/1982 | Japan . |
| 59-195659 | 11/1984 | Japan . |
| 61-043752 | 3/1986 | Japan . |
| 61-043753 | 3/1986 | Japan . |
| 61-043754 | 3/1986 | Japan . |
| 61-209456 | 9/1986 | Japan . |
| 62-006262 | 1/1987 | Japan . |

OTHER PUBLICATIONS

J. Pecansky, et al. Chem. Mater 4:401–409 (1992).
T. Nakazawa et al. Chem. Lett. 1992, 1125–1128.
E. Matsuda et al. Chem. Lett. 1992, 1129–1132.

*Primary Examiner*—Roland Martin
*Attorney, Agent, or Firm*—John A. Brady

[57] ABSTRACT

A photoconductor for use in electrophotographic reproduction devices is disclosed. This photoconductor exhibits reduced room light and cycling fatigue without any corresponding negative impact on the sensitivity of the photoconductor. The photoconductor of the present invention includes specifically defined fluorenyl-azine derivatives in its charge transport layer. These materials have the formula:

wherein $R_1$ and $R_2$ independently selected from $C_1$–$C_4$ alkyl and phenyl, and $R_3$ is selected from hydrogen, $C_1$–$C_4$ alkyl, and phenyl.

10 Claims, No Drawings

ELECTROPHOTOGRAPHIC PHOTOCONDUCTOR CONTAINING FLUORENYL-AZINE DERIVATIVES AS CHARGE TRANSPORT ADDITIVES

TECHNICAL FIELD

The present invention relates to an improved photoconductor, used in electrophotographic reproduction devices, having a charge generating layer and a charge transport layer, which exhibits reduced room light and cycling fatigue without negatively impacting on the sensitivity of the photoconductor.

BACKGROUND OF THE INVENTION

The present invention is a layered electrophotographic photoconductor, i.e., a photoconductor having a metal ground plane member on which a charge generation layer and a charge transport layer are coated, in that order. Although these layers are generally separate from each other, they may be combined into a single layer, which provides both charge generation and charge transport functions. Such a photoconductor may optionally include a barrier layer located between the metal ground plane member and the charge generation layer, and/or an adhesion-promoting layer located between the barrier (or ground plane member) and charge generation layer, and/or an overcoat layer on the top surface of the charge transport layer.

In electrophotography, a latent image is created on the surface of an insulating, photoconducting material by selectively exposing an area of this surface to light. A difference in electrostatic charge density is created between the areas on the surface exposed and those unexposed to the light. The latent electrostatic image is developed into a visible image by electrostatic toners containing pigment components and thermoplastic components. The toners, which may be liquids or powders, are selectively attracted to the photoconductor surface, either exposed or unexposed to light, depending upon the relative electrostatic charge on the photoconductor surface and the toner. The photoconductor may be either positively or negatively charged, and the toner system similarly may contain negatively- or positively-charged particles.

A sheet of paper or intermediate transfer medium is given an electrostatic charge opposite that of the toner and then passed close to the photoconductor's surface, pulling the toner from the photoconductor surface onto the paper or the transfer medium still in the pattern of the image developed from the photoconductor surface. A set of fuser rolls melts and fixes the toner on the paper, subsequent to direct transfer or indirect transfer when an intermediate transfer medium is used, producing the printed image.

The electrostatic printing process, therefore, comprises an on-going series of steps in which the photoconductor surface is charged and discharged as the printing takes place. It is important to keep the charge voltage on the surface of the photoconductor relatively constant as different pages are printed to make sure that the quality of the images produced is uniform (cycling stability). If the charge/discharge voltage is changed significantly each time the drum is cycled, i.e., if there is fatigue or other significant change in the photoconductor surface, the quality of the pages printed will not be uniform and will not be satisfactory.

Hydrazone derivatives, which have frequently been employed as charge transfer molecules and organic photoconductors for electrophotography, possess interesting photochemical properties which are known to connect closely with the so-called fatigue phenomenon of photoconductors. A good deal of research supports the fact that photoisomerization and photochemical reactions are responsible in large part for the fatigue phenomenon. For example, p-(diethylamino) benzaldehyde diphenyl hydrazone (DEH) undergoes a photochemically-induced unimolecular rearrangement to the indazole derivative, 1-phenyl-3-(4-(diethylamino)-1-phenyl)-1,3-indazole. The following articles give an overview of the mechanism of photo-induced fatigue in electrophotographic conductors: J. Pacansky, et al., Chem. Mater. 4:401(1992); T. Nakazawa, et al, Chem. Lett. 1992, 1125; and E. Matsuda, et al., Chem. Lett. 1992, 1129.

In order to use hydrazones as charge transport molecules for electrophotographic applications, photo-induced fatigue has to be reduced to an acceptable level. There are two major paths to minimize photo-induced chemical changes in hydrazone molecules such that photo-induced fatigue of photoconductors can be improved: (1) introducing appropriate substitution on the hydrazone molecules to increase rigidity such that photo-induced cyclization or isomerization can be hindered; and (2) formulating with additives, e.g., a light absorber, in the charge transport layer to filter away the harmful wavelength light (See, for example, U.S. Pat. No. 4,362,798, Anderson, et al.). The former approach will inevitably increase the cost to produce the molecules as compared with the corresponding unsubstituted hydrazones. Therefore, the approach of current choice is the use of additives, such as Acetosol Yellow, to serve as a light filter. Although this approach is effective in reducing room light fatigue of the photoconductor to a certain degree, it also negatively effects the electrical properties of the photoreceptor by increasing discharge voltage and dark decay.

Azines, which are the product of condensing the remaining $NH_2$ of a hydrazone with a carbonyl compound, have been disclosed for use in electrophotographic applications, both as transport molecules and as dopants in charge transport layers. Several series of hydrazones and azines are disclosed as charge transport materials in DE3716982, JP62006262 and JP61209456. In addition, some azines have been taught to be used in combination with hydrazones in electrophotographic conductors (see, for example, JP61043752, JP61043753, and JP61043754). It is important to note that these azines are not the fluorenyl-azine derivatives used in the present invention.

Fluorenyl-azines are known in the art. For example, 9-[p-(diethylamino) benzylidenehydrazono)] fluorene has been disclosed in JP57138644 and JP59195659 as a charge transport agent.

U.S. Pat. No. 4,415,640, Goto, et al, issued Nov. 15, 1983, discloses flourenyl-azines of the type utilized in the present development. The materials are disclosed as charge transport materials, not as adjunct materials used together with another charge transport molecule (see, for example, column 6, lines 52–54; column 7, lines 30–32; and column 8, lines 62–68). The use of these fluorenyl-azines as charge transport materials is taught to minimize photoconductor fatigue.

It has now unexpectedly been found that addition to a DEH-containing charge-transport layer of a flourenyl-azine material provides elimination of room light fatigue and cycling fatigue in the resulting photoconductor. For example, a photoconductor containing a DEH-charge transport layer doped with 2–5% azine, exhibits no fatigue after four hours of fluorescent light exposure, while the same photoconductor containing the standard Acetosol Yellow filtering agent exhibits negative fatigue. Increasing the Acetosol Yellow concentration in the charge transport layer, results in negative affects on the sensitivity of the photoconductor and dark decay, while no such effects are observed with the azine material.

SUMMARY OF THE INVENTION

The present invention relates to an electrophotographic imaging member comprising a charge transport layer comprised of a hydrazone charge transport molecule, such as p-(diethylamino) benzaldehyde diphenyl hydrazone (DEH), a polymeric binder, and an additive having the formula:

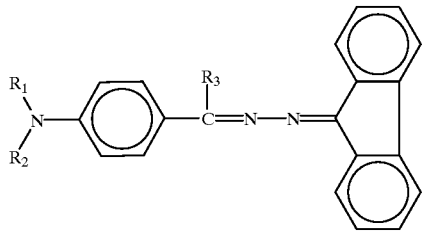

wherein $R_1$ and $R_2$ are independently selected from $C_1$–$C_4$ alkyl and phenyl, and $R_3$ is selected from hydrogen, $C_1$–$C_4$ alkyl and phenyl.

More specifically, the present invention relates to an electrophotographic member comprising:

(a) a ground plane member;

(b) a charge generating layer carried by said ground plane member comprising an effective amount of a photosensitive dye dispersed in a binder; and (c) a charge transport layer carried by said charge generating layer comprising from about 25% to about 65% by weight of a hydrazone charge transport molecule, such as DEH; from about 34.5% to about 65% by weight of a polymeric binder; and from about 0.5% to about 10% by weight of an additive having the formula:

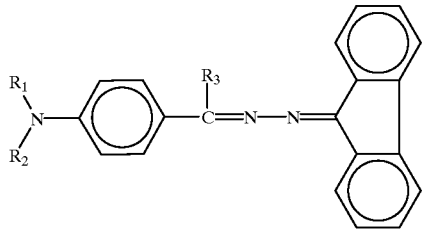

wherein $R_1$ and $R_2$ are independently selected from $C_1$–$C_4$ alkyl and phenyl, and $R_3$ is selected from hydrogen, $C_1$–$C_4$ alkyl and phenyl.

As used herein, all percentages, ratios and parts are "by weight", unless otherwise specified.

DETAILED DESCRIPTION OF THE INVENTION

Photoconductors of the present invention find utility in electrophotographic reproduction devices, such as copiers and printers, and may be generally characterized as layered photoconductors wherein one layer (the charge generating layer) absorbs light and, as a result, generates an electrical charge carrier, while a second layer (the charge transport layer) transports the charged carriers to the exposed surface of the photoconductor.

While these devices frequently have separate charge generation and charge transport layers with the charge transport layer being overlaid on the charge generating layer, it is also possible to combine the charge generator and charge transport functions into a single layer in the photoconductor.

In the photoconductor structure, a substrate, which may be flexible (such as a flexible web or a belt) or inflexible (such as a drum), is uniformly coated with a thin layer of metallic aluminum. The aluminum layer functions as an electrical ground plane. In a preferred embodiment, the aluminum is anodized which turns the aluminum surface into a thicker aluminum oxide surface (having a thickness of about 2 to about 12$\mu$, preferably from about 4 to about 7$\mu$). The ground plane member may be a metallic plate (made, for example, from aluminum or nickel), a metallic drum or a foil, a plastic film on which, for example, aluminum, tin oxide or indium oxide is vacuum-evaporated, or a conductive substance-coated paper, plastic film or drum.

The aluminum layer is then coated with a thin, uniform thickness charge-generating layer comprising a photosensitive dye material dispersed in a binder. Finally, the uniform thickness charge transport layer is coated onto the charge generating layer. The charge transport layer comprises a thermoplastic film-forming binder, a hydrazone charge transport molecule, and an effective amount of a specific fluorenyl-azine additive material.

In the case of a single layer structure, the photosensitive layer comprises a charge generating material, a hydrazone charge transport material, a binder resin, and the fluorenyl-azine material.

The thickness of the various layers in the structure is important and is well known to those skilled in the art. In an exemplary conductor, the ground plane layer has a thickness of from about 0.01 to about 0.07$\mu$; the charge generating layer has a thickness of from about 0.5 to 5.0$\mu$, preferably from about 0.1 to 2.0$\mu$, most preferably from about 0.1 to about 0.5$\mu$; and the charge transport layer has a thickness of from about 10 to about 25$\mu$, preferably from about 20 to about 25$\mu$. If a barrier layer is used between the ground plane and the charge generating layer, it has a thickness of from about 0.05 to 2.0$\mu$. Where a single charge generating/charge transport layer is used, that layer generally has a thickness of from about 10 to about 25$\mu$.

In forming a charge generating layer utilized in the present invention, a fine dispersion of a small particle photosensitive dye material is formed in the binder material, and this dispersion is coated onto the ground plane member. This is generally done by preparing the dispersion containing the photosensitive dye and the binder in a solvent, coating the dispersion onto the ground plane member, and drying the coating.

Any organic photosensitive dye material known in the art to be useful in photoconductors may be used in the present invention. Examples of such materials belong to any of the following classes:

(a) polynuclear quinones, e.g., anthanthrones;

(b) quinacridones;

(c) naphthalene 1, 4, 5, 8-tetracarboxylic acid-derived pigments, such as perinones;

(d) phthalocyanines and naphthalocyanines, e.g., $H_2$-phthalocyanine in X crystaline form (see, for example, U.S. Pat. No. 3,357,989); metal phthalocyanines and naphthalocyanines (including those having additional groups binded to the central metal);

(e) indigo- and thioindigo dyes;

(f) benzothioxanthene derivatives;

(g) perylene 3, 4, 9, 10-tetracarboxylic acid-derived pigments, including condensation products with amines (perylene diimides) and o-diamines (perylene bisimidazoles);

(h) polyazo-pigments, including bisazo-, trisazo-, and tetrakisazo-pigments;

(i) squarylium dyes;

(j) polymethine dyes;

(k) dyes containing quinazoline groups (see, for example, U.K. Patent Specification 1,416,602);

(l) triarylmethane dyes;

(m) dyes containing 1, 5-diamino-anthraquinone groups;

(n) thiapyrylium salts;

(o) azulenium salts;

(p) pyrrolo-pyrrole pigments.

Such materials are described in greater detail in U.S. Pat. No. 5,190,817, Terrell, et al, issued Mar. 2, 1993, incorporated herein by reference.

The preferred photosensitive dyes for use in the present invention are phthalocyanine dyes, which are well-known to those skilled in the art. Examples of such materials are taught in U.S. Pat. No. 3,816,118, Byrne, issued Jun. 11, 1974, incorporated herein by reference. Any suitable phthalocyanine may be used to prepare the charge generating layer portion of the present invention. The phthalocyanine used may be in any suitable crystalline form. It may be unsubstituted either (or both) in the six-membered aromatic rings and at the nitrogens of the five-membered rings. Useful materials are described, and their syntheses given, in Moser & Thomas, *Phthalocyanine Compounds,* Reinhold Publishing Company 1963, incorporated herein by reference. Particularly preferred phthalocyanine materials are those in which the metal central in the structure is titanium (i.e., titanyl phthalocyanines) and metal-free phthalocyanines. The metal-free phthalocyanines are also particularly preferred, especially the X-crystalline form, metal-free phthalocyanines. Such materials are disclosed in U.S. Pat. No. 3,357,989, Byrne, et al, issued Dec. 12, 1967; U.S. Pat. No. 3,816,118, Byrne, issued Jun. 11, 1974; and U.S. Pat. No. 5,204,200, Kobata, et al, issued Apr. 20, 1993, all of which are incorporated herein by reference. The X-type non-metal phthalocyanine is represented by the formula:

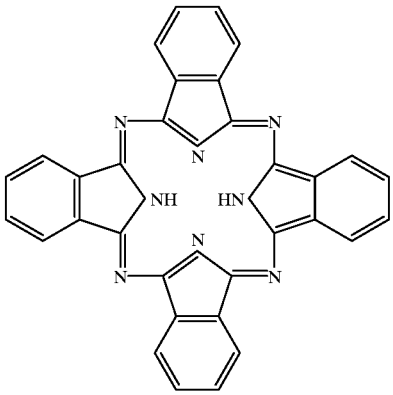

Such materials are available in an electrophotographic grade of very high purity, for example, under the trade name Progen-XPC from Zeneca Colours Company.

As the binder, a high molecular weight polymer having hydrophobic properties and good film-forming properties for an electrically insulating film is preferably used. These high molecular weight film-forming polymers include, for example, the following materials, but are not limited thereto: polycarbonates, polyesters; methacrylic resins, acrylic resins, polyvinyl chlorides, polyvinylidene chlorides, polystyrenes, polyvinylbutyrals, ester-carbonate copolymers, polyvinyl acetates, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenyl-formaldehyde resins, styrene-alkyd resins, and poly-N-vinylcarbazoles. These binders can be used in the form of a single resin or in a mixture of two or more resins.

Preferred materials include the bisphenol A and bisphenol A—bisphenol TMC copolymers described below, medium molecular weight polyvinyl chlorides, polyvinylbutyrals, ester-carbonate copolymers, and mixtures thereof. The polyvinyl chloride compounds useful as binders have an average molecular weight (weight average) of from about 25,000 to about 300,000, preferably from about 50,000 to about 125,000, most preferably about 80,000. The PVC material may contain a variety of substituents including chlorine, oxirane, acrylonitrile or butyral, although the preferred material is unsubstituted. Polyvinyl chloride materials useful in the present invention are well-known to those skilled in the art. Examples of such materials are commercially available as GEON 110X426 from the GEON Company. Similar polyvinyl chlorides are also available from the Union Carbide Corporation.

Bisphenol A, having the formula given below, is a useful binder herein:

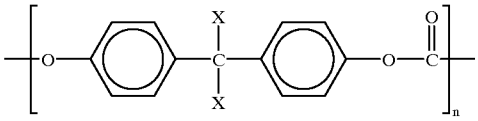

wherein each X is a $C_1$–$C_4$ akyl and n is from about 20 to about 200.

The bisphenol copolymer binders referred to above are copolymers of bisphenol A and bisphenol TMC. This copolymer has the following formula:

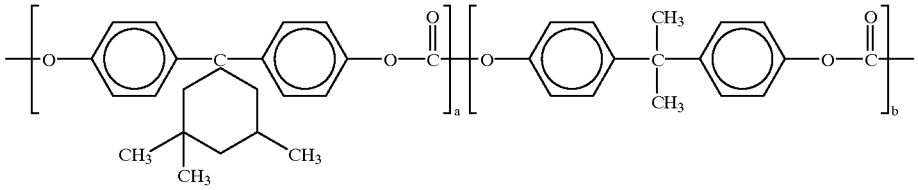

wherein a and b are selected such that the weight ratio of bisphenol A to bisphenol TMC is from about 30:70 to about 70:30, preferably from about 35:65 to about 65:35, most preferably from about 40:60 to about 60:40. The molecular weight (weight average) of the polymer is from about 10,000 to about 100,000, preferably from about 20,000 to about 50,000, most preferably from about 30,000 to about 40,000.

In forming the charge-generating layer, a mixture of the photosensitive dye is formed in the binder material. The amount of photosensitive dye used is that amount that is effective to provide the charge generation function in the photoconductor. This mixture generally contains from about 10 parts to about 50 parts, preferably from about 10 parts to about 30 parts, most preferably about 20 parts of the photosensitive dye component, and from about 50 parts to about 90 parts, preferably from about 70 parts to about 90 parts, most preferably about 80 parts of the binder component.

The photosensitive dye-binder mixture is then mixed with a solvent or dispersing medium for further processing. The solvent selected should: (1) be a true solvent for high molecular weight polymers; (2) be non-reactive with all components; and (3) have low toxicity. Examples of dispersing media/solvents that may be utilized in the present invention, used either alone or in combination with preferred solvents, include hydrocarbons, such as hexane, benzene, toluene, and xylene; halogenated hydrocarbons, such as methylene chloride, methylene bromide, 1,2-dichloroethane, 1,1,2-trichloroethane, 1,1,1-trichloroethane, 1,2-dichloropropane, chloroform, bromoform, and chlorobenzene; ketones, such as acetone, methylethyl ketone, and cyclohexanone; esters, such as ethyl acetate and butyl acetate; alcohols, such as methanol, ethanol, propanol, butanol, cyclohexanol, heptanol, ethylene glycol, methyl cellosolve, ethyl cellosolve, and cellosolve acetate, and derivatives thereof; ethers and acetals, such as tetrahydrofuran, 1,4-dioxane, furan and furfural; amines, such as pyridine, butylamine, diethylamine, ethylene diamine, and isopropanolamine; nitrogen compounds, including amides, such as N, N-dimethylformamide; fatty acids and phenols; and sulfur and phosphorous compounds, such as carbon disulfide and triethylphosphate. The preferred solvents for use in the present invention are methylethyl ketone, methylene chloride, cyclohexanone and tetrahydrofuran (THF). The mixtures formed include from about 1% to about 50%, preferably from about 2% to about 10%, most preferably about 5%, of the photosensitive dye/binder mixture, and from about 50% to about 99%, preferably from about 90% to about 98%, most preferably about 95%, of the solvent/dispersing medium. The entire mixture is then ground, using a conventional grinding mechanism, until the desired dye particle size is reached and is dispersed in the mixture. The organic pigment may be pulverized into fine particles using, for example, a ball mill, homogenizer, paint shaker, sand mill, ultrasonic disperser, attritor or sand grinder. The preferred device is a sand mill grinder. The photosensitive dye has a particle size (after grinding) ranging from sub-micron (e.g., about 0.01$\mu$) to about 5$\mu$, with a particle size of from about 0.05$\mu$ to about 0.5$\mu$ being preferred. The mixture may then be "let down" or diluted with additional solvent to from about 2% to about 5% solids , providing a viscosity appropriate for coating, for example, by dip-coating.

The charge-generating layer is then coated onto the ground plan member. The dispersion from which the charge generating layer is formed is coated onto the ground plane member using methods well-known in the art, including dip-coating, spray coating, blade coating or roll coating, and is then dried. The preferred method for use in the present invention is dip coating. The thickness of the charge generating layer formed should preferably be from about 0.1 to about 2.0$\mu$, preferably about 0.5$\mu$. The thickness of the layer formed will depend upon the percent solids of the dispersion into which the ground plane member is dipped, as well as the time and temperature of the process. Once the ground plane member has been coated with the charge-generating layer, it is allowed to dry for a period of from about 10 to about 100 minutes, preferably from about 30 to about 60 minutes, at a temperature of from about 60° C. to about 160° C., preferably about 100° C.

The charge transport layer is then prepared and coated on the ground plane member so as to cover the charge generating layer. The charge transport layer is formed from a solution containing a hydrazone charge transport molecule in a thermoplastic film-forming binder, including therein a specifically defined group of fluorenyl-azine materials, coating the solution onto the charge-generating layer and drying the coating.

In principle, a large class of known whole or electron transport molecules may be used in the transport layer of an electrophotographic photoconductor. However, since the purpose the present invention is to eliminate the fatigue problems seen when hydrazone materials are used as the charge transport molecule, the charge transport molecule used in the present invention is selected from the class of hydrazone materials having the following general formula:

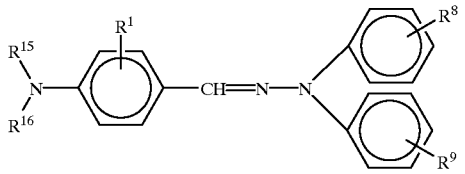

wherein $R^1$, $R^8$ and $R^9$, independently from each other, represent a hydrogen or a lower alkyl ($C_1$–$C_4$), and $R^{15}$ and $R^{16}$, independently from each other, represent a lower alkyl ($C_1$–$C_4$) or aryl.

The most preferred charge transport molecule is known as DEH, having the chemical name p-diethylaminobenzaldehyde-N,N-diphenylhydrazone. This compound has the following structural formula:

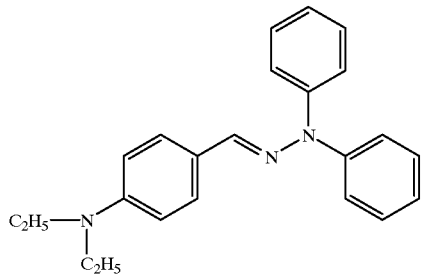

The binders used in the charge transport layer of the present invention are the binders described above which are used in the charge generating layer.

The charge transport layer also contains specifically defined fluorenyl-azine materials having the following formula:

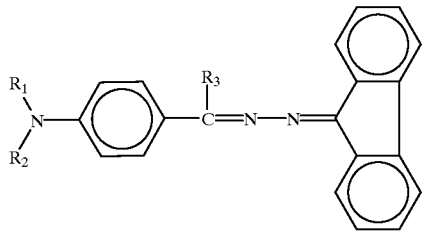

wherein $R_1$ and $R_2$ are independently selected from $C_1$–$C_4$ alkyl and phenyl, and $R_3$ is selected from hydrogen, $C_1$–$C_4$ alkyl, and phenyl. In preferred compounds, $R_1$ and $R_2$ are selected from ethyl and phenyl, while $R_3$ is selected from hydrogen and phenyl. Particularly preferred compounds are the ones in which both $R_1$ and $R_2$ are ethyl and $R_3$ is hydrogen, as well as the one in which both are $R_1$ and $R_2$ are phenyl and $R_3$ is hydrogen.

9-(p-diethylaminobenzylidenehydrazono) fluorene ($R_1$=$R_2$=ethyl and $R_3$=hydrogen) may be synthesized in the following manner. A mixture of 9H-fluorenohydrazone (19.4 g, 0.1 mol), p-diethylaminobenzaldehyde (19.4 g, 0.11 mol), benzene (200 ml) and a catalytic amount of p-tolylsulfonic hydrate is stirred at ambient temperature for about three hours. Water (100 ml) is then added. The organic layer is separated, washed with water twice, washed with brine, and dried over sodium sulfate. The solvent is removed and an orange solid recrystallized from a mixture of acetone and hexane to yield the title compound (orange needles at 92%). 9-(p-diphenylaminobenzylidenehydrazono) fluorene ($R_1$=$R_2$=phenyl and $R_3$=hydrogen) may be prepared in an analogous manner.

The mixture of hydrazone charge transport molecule (as disclosed), binder and fluorenyl-azine derivatives having a composition of from about 25% to about 65%, preferably from about 30% to about 50%, most preferably from about 35% to about 45% of the hydrazone charge transport molecule; from about 34.5% to about 65%, preferably from about 50% to about 65%, most preferably from about 55% to about 65% of the binder; and from about 0.5% to about 10%, preferably from about 1% to about 5%, most preferably from about 2% to about 5% of the fluorenyl-azine derivative is then formulated. The amount of charge transport molecule utilized is that amount that is effective to perform the charge transport function in the photoconductor. The binders are used, both in the charge transport and charge generating layers, in an amount effective to perform their binder function. Fluorenyl-azine materials are preferably added to the organic solvent before the other components are added.

The mixture is added to a solvent, such as those discussed above for use in forming the charge generation layer. Preferred solvents are THF, cyclohexanone, and methylene chloride. It is preferred that the solution contain from about 10% to about 40%, preferably about 25% of the binder/transport molecule/fluorenyl-azine mixture, and from about 60% to about 90%, preferably about 75% of the solvent. The charge transport layer is then coated onto the charge generating layer and the ground plane member using any of the conventional coating techniques discussed above. Dip coating is preferred. The thickness of the charge transport layer is generally from about 10 to about 25$\mu$, preferably from about 20 to about 25$\mu$. The percentage of solids in the solution, viscosity, the temperature of the solution, and the withdrawal speed control the thickness of the transport layer. The layer is usually heat dried for from about 10 to about 100 minutes, preferably from about 30 to about 60 minutes, at a temperature of from about 60° C. to about 160° C., preferably about 100° C. Once the transport layer is formed on the electrophotographic member, pretreatment of the layer by either using UV curing or thermal annealing is preferred in that it further reduces the rate of transport molecule leaching, especially at higher transport molecule concentrations.

In addition to the layers discussed above, an undercoat layer may be placed between the ground plane member (substrate) and the charge generating layer. This is essentially a primer layer which covers over any imperfections in the substrate layer, and improves the uniformity of the thin charge layer formed. Materials that may be used to form this undercoat layer include epoxy, polyamide and polyurethane. It is also possible to place an overcoat layer (i.e., a surface protecting layer) on top of the transport layer. This protects the charge transport layer from wear and abrasion during the printing process. Materials which may be used to form this overcoat layer include polyurethane, phenolic, polyamide, and epoxy resins. These structures are well-known to those skilled in the art.

The following example illustrates the photoconductors of the present invention. The example is intended to be illustrative only and not limiting of the scope of the present invention.

EXAMPLE

In order to provide a basis of comparison, drum and web photoconductors, which contain DEH with Acetosol Yellow in the charge transport layer and DEH with fluorenyl-azine derivative in the charge transport layer are made and tested under similar conditions.

Formulation

The charge generation (CG) dispersion consists of titanyl phthalocyanine and polyvinylbutyral (BX-55Z, Sekisui Chemical Co.) in a weight ratio of 45/55 in a mixture of 2-butanone and cyclohexanone. The CG dispersion is dip coated on the aluminum substrate and dried at 100° C. for 15 minutes or blade coated on mylar film to give a thickness less than 1$\mu$, and more preferably, 0.2–0.3$\mu$.

A standard charge transport formulation (CT) containing DEH is prepared in the following manner. DEH (27.0 g), bisphenol-A (39.7 g, Makrolon 5208, Bayer AG) and Acetosol Yellow (0.48 g) are mixed in a solvent mixture which includes tetrahydrofuran and 1,4-dioxane. The CT layer is dip coated on the CG coated drum or blade coated on the CG coated film, which are then dried at 100° C. for 60 minutes.

Similar charge transport layers were formulated as above, except that in place of the Acetosol Yellow, azine-1 (0.48 g, $R_1$=$R_2$=ethyl, $R_3$=hydrogen) and azine-2 (0.48 g, $R_1$=$R_2$=phenyl, $R_3$=hydrogen) are used in place of Acetosol Yellow.

Testing

The layered photoconductors, prepared as described above, are then tested either by parametric tester or by Shogun tester. The web films are measured for initial electrical properties with and without room light exposure for a certain period of time. Cycling fatigue is evaluated by measuring the electricals of the samples directly before and after cycling in the Shogun tester. The light fatigue of the drums is induced by exposing the drum to a fluorescent light source. The results of the testing is summarized in the following table:

| Drum | Initial $V_{0.25}$ (−V) | 2-hr light $V_{0.25}$(−V) | Fatigue (−V) | Initial $V_{res}$ (−V) | 2-hr light $V_{res}$(−V) | Fatigue (−V) |
|---|---|---|---|---|---|---|
| Acetosol Yellow | 386 | 432 | 46 | 166 | 275 | 109 |
| Azine 1 | 402 | 433 | 31 | 167 | 217 | 50 |
| Azine 2 | 395 | 381 | −14 | 172 | 171 | −1 |

The azine derivatives, as defined in the present application, clearly acted to reduce room light and cycling fatigue without negatively impacting on the sensitivity of the photoconductor itself.

What is claimed is:

1. An electrophotographic imaging member comprising a charge generation material and a charge transport layer comprised of a first hydrazone charge transport molecule, a polymeric binder, and an additive having the formula:

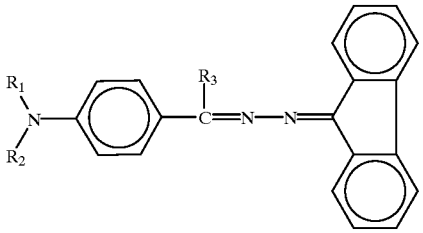

wherein $R_1$ and $R_2$ are independently elected from the group consisting of $C_1$–$C_4$ alkyl and phenyl and $R_3$ is selected from hydrogen, $C_1$–$C_4$ alkyl, and phenyl, said first hydrazone molecule not being a fluorenyl-azine and said additive being from about 0.5% to about 10% weight of the weight of said charge transport layer and said first hydrazone being about 25% to about 65% by weight of said charge transport layer.

2. An electrophotographic imaging member comprising a charge generation material and a charge transport layer comprised of p-diethylamino benzaldehyde, N,N-diphenyl hydrazone (DEH) as a charge transport molecule, a polymeric binder, and an additive having the formula:

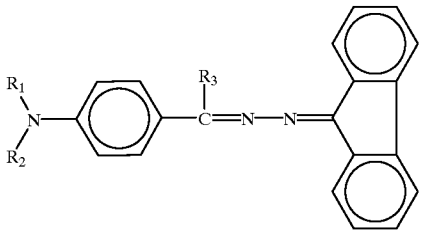

wherein $R_1$ and $R_2$ are independently elected from the group consisting of $C_1$–$C_4$ alkyl and phenyl and $R_3$ is selected from hydrogen, $C_1$–$C_4$ alkyl, and phenyl.

3. The electrophotographic imaging member according to claim 2 wherein the additive comprises from about 0.5% to about 10% of the charge transport layer.

4. The electrophotographic imaging member according to claim 3 wherein the additive comprises from about 1% to about 5% of the charge transport layer.

5. The electrophotographic imaging member according to claim 4 wherein, in the additive, $R_1$ and $R_2$ are each independently selected from ethyl and phenyl, and $R_3$ is selected from hydrogen and phenyl.

6. The electrophotographic imaging member according to claim 5 wherein, in the additive, both $R_1$ and $R_2$ are ethyl and $R_3$ is hydrogen.

7. The electrophotographic imaging member according to claim 5 wherein, in the additive, $R_1$ and $R_2$ are phenyl, and $R_3$ is hydrogen.

8. The electrophotographic imaging member according to claim 5 wherein the charge transport layer has a thickness of from about 10 to about 25$\mu$.

9. The electrophotographic imaging member according to claim 8 wherein the polymeric binder has the formula:

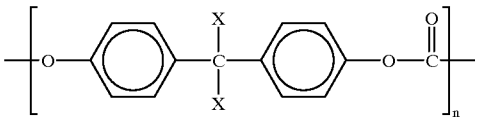

wherein X is selected from $C_1$–$C_4$ alkyl, and n is from about 20 to about 200.

10. An electrophotographic imaging member comprising:

(a) a ground plane member;

(b) a charge generating layer carried by said ground plane member comprising an effective amount of a photosensitive dye dispersed in a binder; and (c) a charge transport layer carried by said charge generating layer comprising from about 25% to about 65% by weight of DEH charge transport molecule; from about 35% to about 65% by weight of a polymeric binder; and from about 1% to about 5% by weight of an additive having the formula:

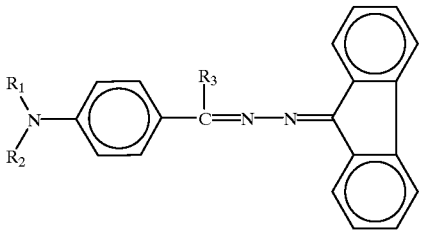
wherein $R_1$ and $R_2$ are independently selected from $C_1$–$C_4$ alkyl and phenyl, and $R_3$ is selected from hydrogen, $C_1$–$C_4$ alkyl and phenyl.
* * * * *